United States Patent [19]

Skliris

[11] 3,999,460

[45] Dec. 28, 1976

[54] ROCKET LAUNCHING MECHANISM

[76] Inventor: Lewis E. Skliris, 335 Potomac Ave., Quantico, Va. 22134

[22] Filed: Dec. 3, 1975

[21] Appl. No.: 637,192

[52] U.S. Cl. ..... 89/1.803; 89/1.804; 89/1.814; 89/1.816

[51] Int. Cl.[2] ..... F41F 3/04

[58] Field of Search ..... 89/1.803, 1.804, 1.802, 89/1.814, 1.816

[56] References Cited

UNITED STATES PATENTS

| | | | |
|---|---|---|---|
| 2,717,534 | 9/1955 | Atherton | 89/1.803 |
| 2,801,572 | 8/1957 | Bonnett | 89/1.803 |
| 3,401,597 | 9/1968 | Comte et al. | 89/1.816 X |
| 3,444,778 | 5/1969 | Bates | 89/1.804 |
| 3,601,000 | 8/1971 | Schneider | 89/1.803 X |

FOREIGN PATENTS OR APPLICATIONS

| | | | |
|---|---|---|---|
| 575,546 | 5/1959 | Canada | 89/1.804 |

*Primary Examiner*—David H. Brown
*Attorney, Agent, or Firm*—Boris Haskell; Alfred B. Levine

[57] ABSTRACT

A rocket launching mechanism for a shoulder held weapon which permits substantialy continuous loading and firing. A two trigger system is employed — one for firing the rocket and a second for releasing a stop mechanism which permits a spring drive means to advance a rotary feed mechanism. The rockets are loaded into a magazine which includes a cylindrical outer housing member and an inner rotor member which cooperate to form individual chambers for the rockets. A trap door means is provided in the outer housing to permit access to the rocket chambers, whereby misfired rockets may be removed, and the magazine may be readily loaded and reloaded in the field.

11 Claims, 6 Drawing Figures

ROCKET LAUNCHING MECHANISM

This invention relates to a portable rocket launching mechanism and, more particularly, to a shoulder supported mechanism from which rockets may be fired on a substantially continuous basis.

Heretofore, it has been known to employ loading devices and magazines for shoulder held weapons used to fire rockets, but the devices and magazines have been deficient in at least two major respects. First, the loading devices have been relatively complicated and bulky making their transport difficult. Second, the magazines have been self-contained so that individual chambers of the magazine cannot be reloaded after firing and/or cleared of misfires.

In accordance with the present invention, the foregoing difficulties and shortcomings of the prior art are effectively overcome for a rocket launching mechanism. In particular, a magazine is employed wherein an outer housing member and an inner rotor member cooperate to form individual chambers for the rockets to be fired. The inner rotor member is rotated with respect to the outer housing member to effect sequential indexing of the rockets within the magazine. A trap door means is provided in the outer housing member which enables the user to gain access to a chamber after a rocket has been fired, or to gain access to the chambers sequentially, if desired. Thus, the magazine may be quickly and easily loaded in the field and during operation, and misfires may be quickly cleared from the chamber. It is contemplated that one person will hold and fire the weapon while another inspects the chamber after firing and loads a fresh rocket therein. It is, of course, possible for the weapon to be fired as a single shot weapon.

In the present launcher a two trigger system is employed. The first trigger fires a rocket which is in position for firing. Any suitable and conventional means may be used as a first trigger mechanism to fire the rocket. A second trigger mechanism is used to release a stop assembly means and effect rotation of the magazine to bring the next succeeding chamber in the magazine into alignment with the barrel of the weapon. This indexing motion effects a positioning of the rocket so that it is ready to be fired by the first trigger mechanism already mentioned.

It is therefore one object of the present invention to provide an automatic hand held rocket launcher.

Another object of the invention is to provide such a launcher having a magazine having a plurality of chambers for holding a plurality of rockets, and wherein said chambers are sequentially positioned into firing position.

And still another object of the present invention is to provide such a launcher wherein a misfire may be readily cleared from a chamber, and wherein the magazine may be readily loaded and reloaded in the field, to permit substantially continuous operation.

These and other objects, advantages and improvements of the present invention will become more readily apparent upon considering the followed detailed description of the invention and by reference to the accompanying drawings in which.

Figure 1:
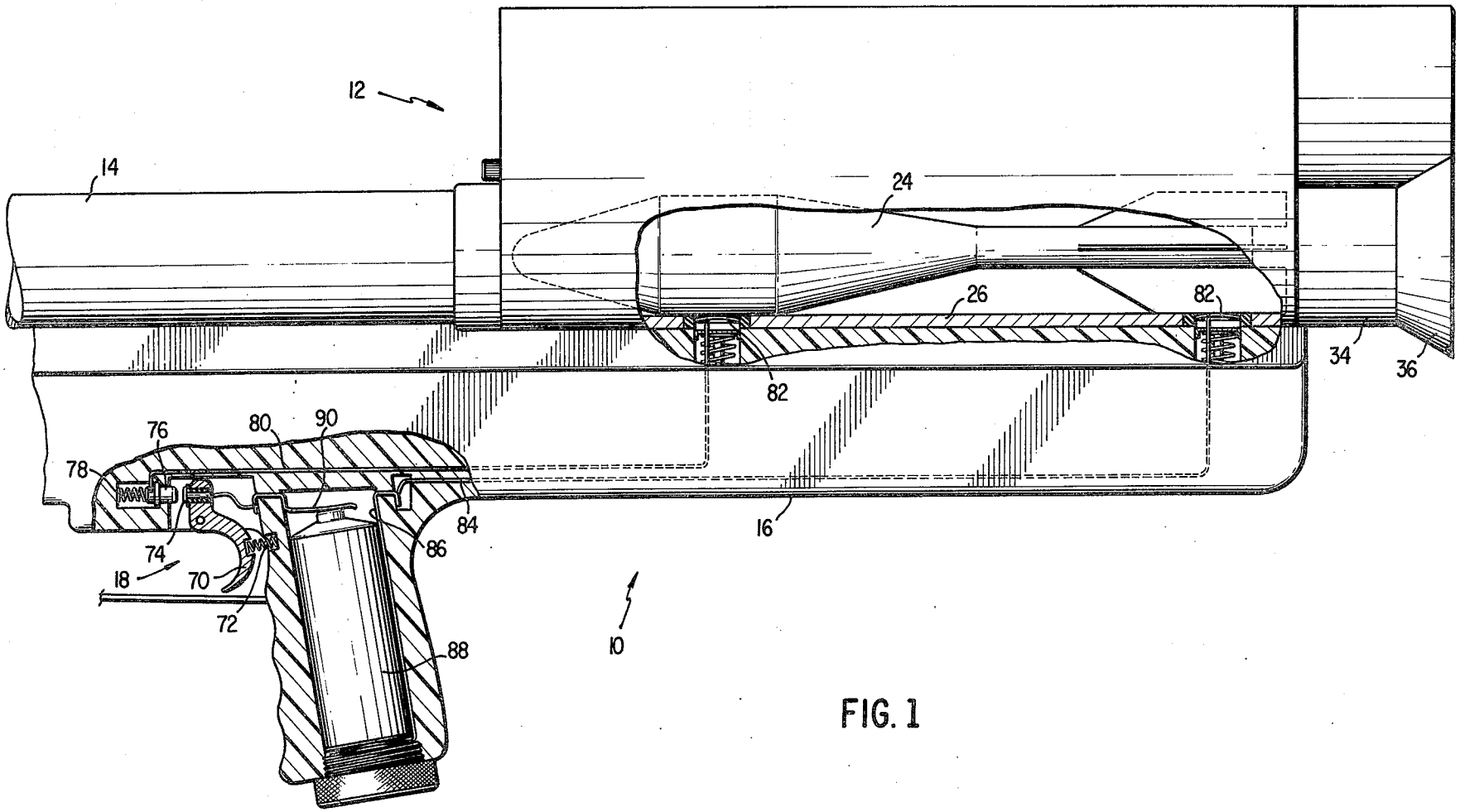
FIG. 1 is a fragmentary side elevational view which is partially cut away, illustrating the rocket launching mechanism of the present invention.
Figure 2:
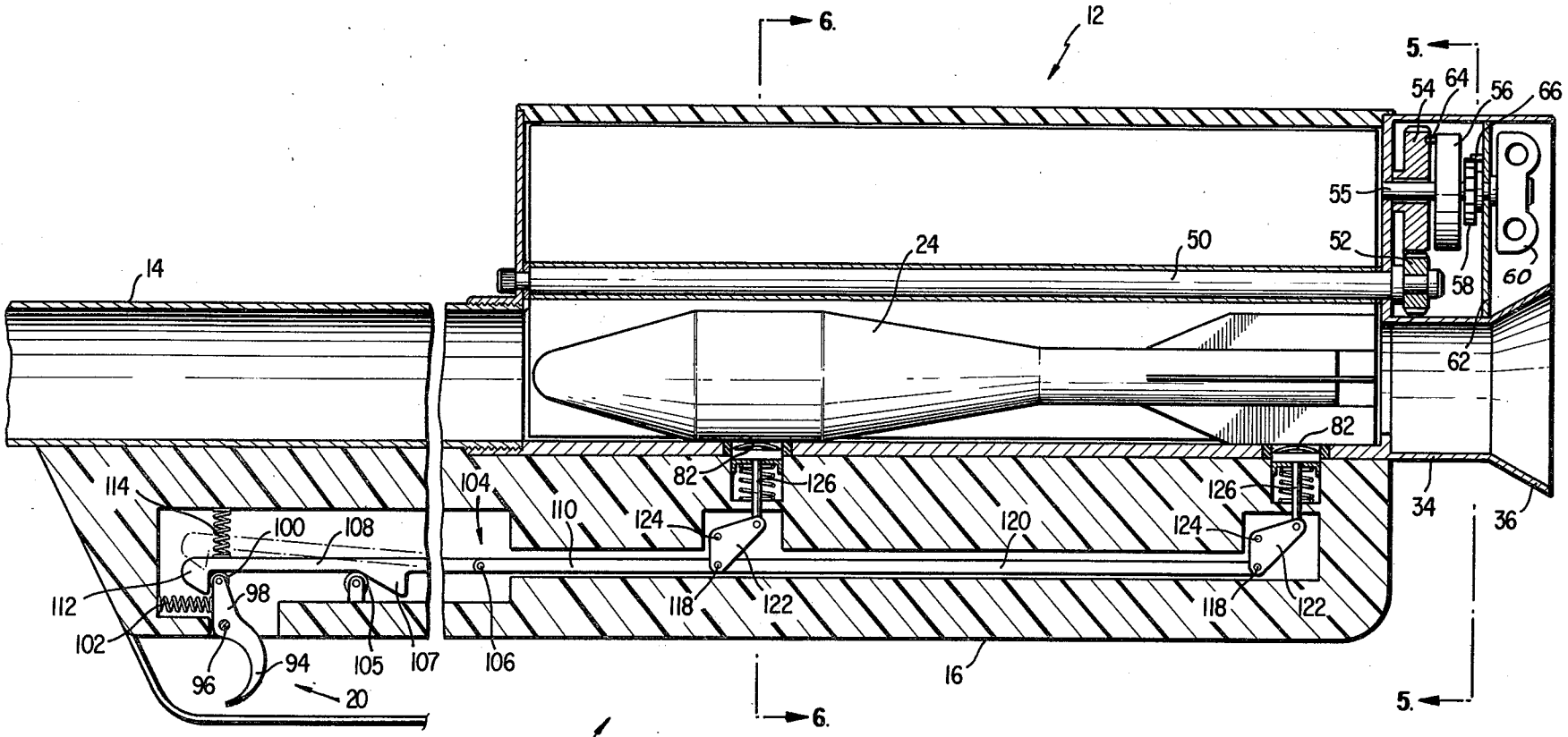
FIG. 2 is a fragmentary longitudinal sectional view taken along line 2—2 as shown in FIG. 6, and illustrating a trigger means used to rotate a magazine which permits substantially continuous rocket firing.

Referring now to FIG. 1 of the drawings, there is illustrated a rocket launcher indicated generally by numeral 10 having a magazine indicated generally by numeral 12. A barrel member 14 is suitably secured thereto, such as by threading as illustrated in FIG. 2, with the composite structure mounted upon by a stock member 16. The barrel member 14 in accordance with conventional practice is made sufficiently long to establish a flight path for the rocket being fired.

Numeral 18 in FIG. 1 designates a first trigger mechanism which is used to activate the ignition sequence, and a second trigger mechanism is indicated generally at 20 in FIG. 2. The first trigger mechanism 18 may be located at any convenient position along stock member 16, either in front of or behind second trigger mechanism 20. As illustrated, the first trigger mechanism 18 is behind second trigger mechanism 20 but is located at the interrupted section location so as not to be reproduced in FIG. 2. The second trigger mechanism 20 controls a stop assembly means 22 indicated generally in FIG. 6 which in turn permits rotation of magazine 12 as will be described hereinafter. One individual rocket 24 within magazine 12 is shown in position to be fired in FIGS. 1 and 2.

Figure 3:
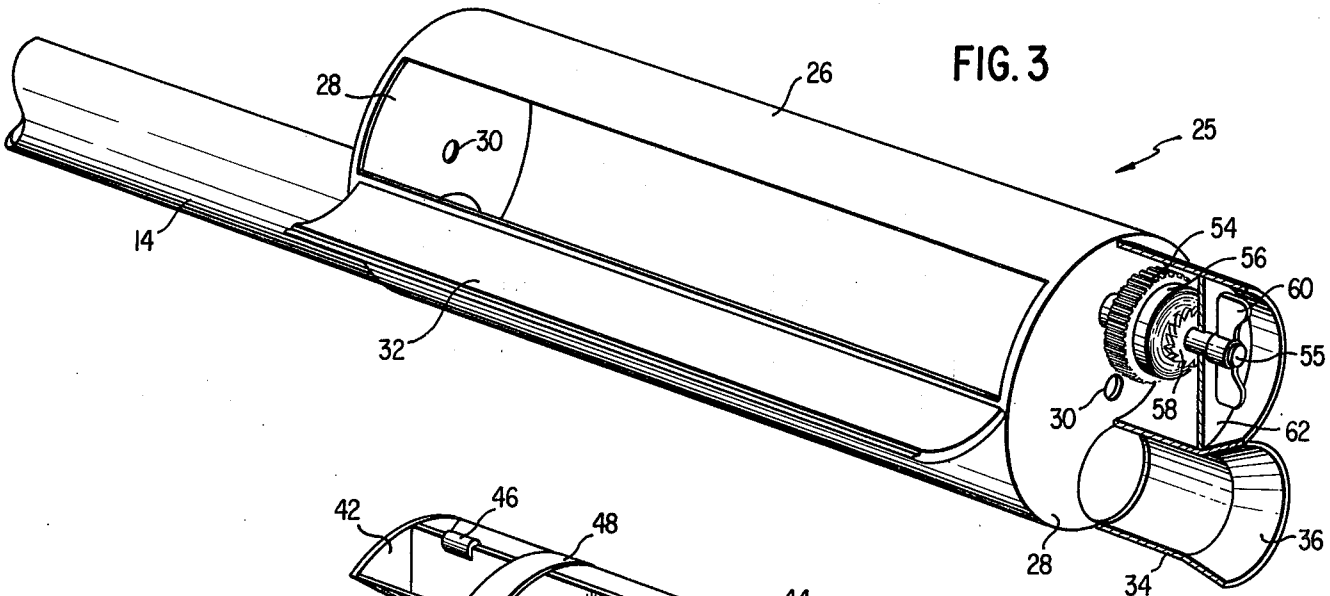
FIG. 3 is a perspective view illustrating an outer housing of the magazine shown in FIGS. 1 and 2, and wherein the internal structure of the magazine is removed to facilitate the illustration of the invention.
Figure 4:
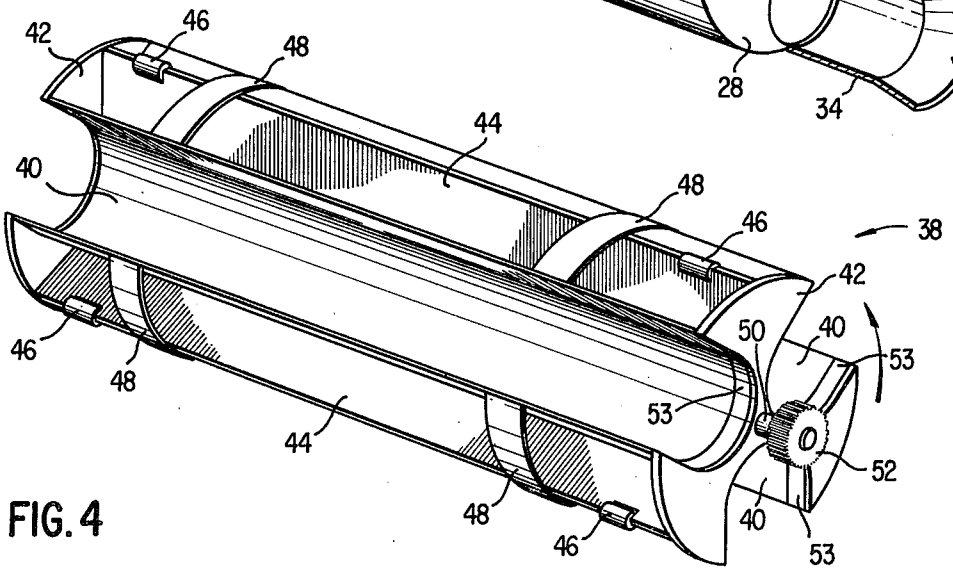
FIG. 4 is a perspective view illustrating the internal structure or inner rotor member for the magazine housing shown in FIG. 3.
Figure 5:
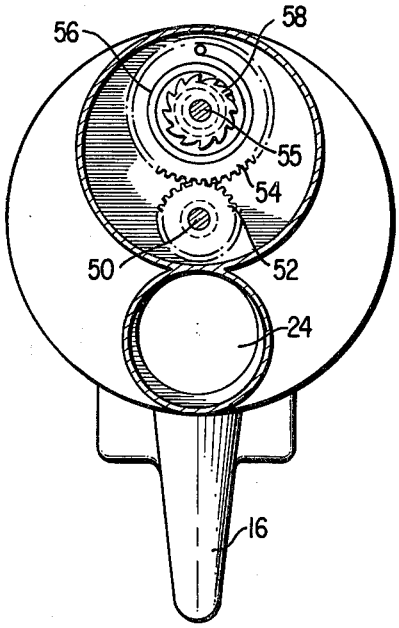
FIG. 5 is a cross sectional view taken along line 5—5 of FIG. 2.

The magazine includes an outer housing member indicated generally at 25 in FIG. 3 and an inner rotor member indicated generally at 38 in FIG. 4. The outer housing member 25 consists of a cylindrical outer housing 26 having end plates 28, each of which is provided with an aperture 30 to receive the shaft 50 of inner rotor member 38 of FIG. 4.

The cylindrical outer housing 26 is also provided with a trap door 32 which is supported by a suitable hinge means to permit opening and closing thereof for access to or inspection of the chamber immediately following the firing of a rocket, and to permit the loading of another rocket 24 to enable substantially continuous firing. The rear end of the cylindrical outer housing 26 is also provided with an exhaust tube 34 and a blast deflector 36. The opening of exhaust tube 34 is preferably made slightly smaller than the chamber within which the rocket is contained so that the rocket will be maintained in position when the front end of barrel 14 is elevated.

The inner rotor member, indicated generally at 38, comprises a plurality of substantially U-shaped grooves or channels 40 (three being provided in the preferred embodiment) which cooperate with the inner surface of cylindrical outer housing 26 to define a plurality of chambers within magazine 12 and within which individual rockets are received. Rotor 38 has a pair of end plate members 42 which effectively seal off the end spaces between adjacent U-shaped grooves 40.

Figure 6:
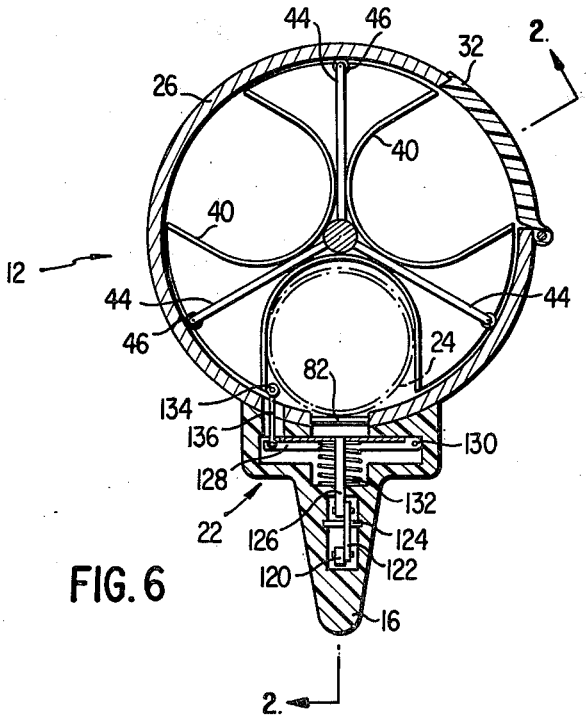
FIG. 6 is a cross sectional view taken along line 6—6 of FIG. 2.

Reference to FIGS. 4 and 6 discloses radially disposed stiffening members 44, the outermost portions of which are provided with roller bearings 46 for engagement with the inner surface of the cylindrical outer housing 26. The inner rotor member 38 is also provided with bands 48 which bridge the spaces between adjacent U-shaped grooves and serve as deflection means for stop assembly means 22 as will become more apparent hereinafter.

Inner rotor member 38 carries a shaft 50 which extends through the apertures 30 in the outer housing member 25 in a manner shown in FIG. 2. Shaft 50 carries a pinion gear 52 which meshes with drive gear 54 which is loosely received on stub shaft 55. A coil spring 56 is wound or tensioned by ratchet 58 with the aid of an external key 60 which extends on the outer side of plate member 62 in FIG. 2. The force of coil spring 56 is transmitted to the drive gear 54 by means of pin connector means 64, and the ratchet 58 prevents unwinding of the tensioned spring 56 by means of a suitable pawl 66 attached to wall 62 and engaging the teeth of ratchet 58.

Reference is again made to FIG. 1 for a more detailed description of the first trigger mechanism 18 used to fire the rocket. Trigger mechanism 18 includes a trigger 70 suitably pivoted to stock member 16 with trigger 70 normally urged to the position illustrated in FIG. 1 by means of spring 72. The upper portion of the trigger carries a movable contact 74 engageable with contact 76 which is spring loaded within stock member 16. An electrical lead 80 extends from contact 76 to one of two brush members 82 engageable with the rocket 24. The circuitry is completed through the rocket in conventional manner and returned from the rear brush member 82 through electrical lead 84 and contact 86 to a battery 88. Electrical lead 90 extends from battery 88 to the movable contact 74. The battery 88 is merely representative of nickel cadmium dry cells or other ignition circuitry which may be used in conventional manner. For some rockets, the inner rotor member 38 may have copper contact bands 53 as shown in FIG. 4 to complete the electrical firing circuitry.

Reference is again made to FIG. 2 for a more detailed description of the second trigger mechanism 20. As was noted previously, this second trigger mechanism is used to release stop assembly means 22 and thereby effect an indexing rotation of the magazine 12. The second trigger mechanism 20 includes a second trigger 94 pivoted at 96 to stock member 16. Trigger 94 has an upper portion 98 which carries a trigger roller 100 normally maintained in the position shown in FIG. 2 by spring 102.

A trigger rod member is indicated generally at 104 in FIG. 2 which has a hinge or pivot point at 106 so as to permit the forward portion 108 of the trigger rod member to pivot between the solid line position and the dotted line position. This pivotal movement is effected when trigger rod 104 is moved to the left as shown in FIG. 2. Such action causes cam 107 to ride up on roller 105, lifting rod section 108 against the force of return spring 114. The forward rod portion 108 carries a trigger catch 112 which is normally in engagement with trigger roller 100 under the influence of spring 114.

The trigger rod member 104 has a first rearward portion 110 and a second rearward portion 120. The first and second rearward sections 110 and 120 are each pivotally connected at 118 to bell cranks 122, each of which is pivotally supported at 124 within stock member 16, as is shown in both FIGS. 2 and 6.

FIGS. 2 and 6 show the details of the stop assembly means 22. It includes lift rods 126 secured to the cam members 122 and cross rods 128 pivoted at 130. Springs 132 normally urge upwards the stop rollers 134 carried at the forward ends of cross rods 128 by means of a vertically extending lever 136.

In operation, with the magazine 12 filled with a rocket in each of its chambers and with one of the chambers in alignment with barrel 14, the operator fires the rocket in the aligned chamber by squeezing trigger 70 of the first trigger mechanism 18. This completes an electrical circuit through contacts 74, 76, electrical lead 80, forward brush 82, then through the rocket itself returning from the rear brush 82 by way of lead 84 to contact 86, battery 88 and contact 90.

After the rocket is fired, the second trigger mechanism 20 is actuated in order to effect indexing of magazine 12. Thus, by squeezing trigger 94 the operator causes trigger rod member 104 to move forwardly to the left in FIG. 2 rotating both cranks 122 clockwise as viewed in this figure about pivots 124 and withdrawing the stop rollers 134 from their position in engagement with the sidewall of a U-shaped groove 40 of the inner rotor member. Rotation of cranks 122 pulls stop assembly means 22 and stop rollers 134 downwardly. When the stop roller is pulled down sufficiently far enough, the inner rotor member 38 begins to rotate counterclockwise in FIG. 6 under the influence of drive gear 54 which is powered by coil spring 56. As the trigger is pulled further the trigger catch is lifted by the action of roll 105 on cam 107 so as to be freed from the trigger roller 100.

The springs 132 acting on cross levers 128 can now push stop rollers 134 upwardly back to the stop position shown in FIG. 6, causing bell cranks 122 to rotate counterclockwise as viewed in FIG. 2, and thus drawing trigger bar 104 toward the right, to the normal rest position shown in FIG. 2. During this action, trigger catch 112 clears the fully advanced trigger roll 100 and spring 114 urges trigger catch 112 downward into the position shown in full lines in FIG. 2. As the inner magazine member 38 rotates to index the next chamber in firing position, stop rollers 134 engage bands 48 until the next rocket chamber in the inner rotor member is reached, at which time the stop rollers are pushed upwardly. The stop rollers 134 roll under the rocket in that chamber and then back up to the position shown in FIG. 6 to engage the side wall of the chamber and to stop the rotation of the inner rotor member 38. When the trigger is released, the spring 102 pushes trigger roller 100 back to the original position illustrated in FIG. 2 by momentarily camming trigger catch 112 upwardly. The launcher is now ready to fire the next rocket.

The trap door means 32 may be opened. If the rocket remains in the chamber by virtue of a misfire, this may now be cleared. If the firing has been accomplished successfully, another rocket may be loaded in the chamber and the trap door 32 closed.

It is apparent from the foregoing description that three rockets in the magazine may be fired in quick succession. By operating the magazine advancing trigger 94, the empty chambers may then be successively aligned with the trap door 32 for reloading, to completely reload the magazine. Alternatively, a single rocket may be fired, and that chamber may be reloaded before the next firing.

The magazine has been illustrated herein to have three chambers although four or more may be used dependent, in part, upon the weight of the rocket to be fired since it is intended that the weapon be carried by a single person. Similarly, although a spring-powered drive means has been disclosed, other drive means may be employed. The chamber access door 32 may obviously be a sliding instead of a hinged panel.

While a presently preferred embodiment of the invention has been illustrated and described, it will be recognized that the invention may be otherwise variously embodied and practiced within the scope of the claims which follow.

What is claimed is:

1. a rocket launching mechanism which comprises:

a. a magazine for containing a plurality of rockets to be fired, said magazine being formed from 1. a cylindrical outer housing member,
2. and an inner rotor member rotatably received within said cylindrical outer housing member,
   i. said inner rotor member having a plurality of longitudinally extending grooves with each of said grooves cooperating with a portion of the inside surface of said cylindrical outer housing member to define a chamber within which an individual rocket is received, b. a barrel member attached to said outer housing member and extending forwardly of said magazine, c. a stock member secured to said outer housing member, d. means for rotating said inner rotor member with respect to said cylindrical outer housing member, e. stop assembly means for stopping the rotation of said inner rotor member when one of said chambers is aligned with said barrel member, f. means to fire a rocket from within said chamber when said chamber is aligned with said barrel member, g. and door means in said outer housing member for gaining access to a chamber after firing a rocket therefrom in order to remove a rocket therefrom in the event of a misfire and to load another rocket therein to permit substantially continuous firing.

2. A rocket launching mechanism as defined in claim 1, wherein said means to fire said rocket includes a battery operated electrical circuit and longitudinally spaced brush members engageable with a rocket within said chamber.

3. A rocket launching mechanism as defined in claim 1, wherein said magazine has more than two chambers therein and said magazine is indexed sequentially from one position to the next in a given direction and said door means permits access to said magazine in the first indexed position following firing.

4. A rocket launching mechanism as defined in claim 1 including roller bearing means carried by said inner rotor member and engageable with the inner surface of said cylindrical outer housing member.

5. A rocket launching mechanism as defined in claim 1 including deflection means engageable with said stop assembly means as said stop assembly means travels between adjacent grooves in said inner rotor member to prevent erroneous positioning of said rotor member.

6. A rocket launching mechanism as defined in claim 1, wherein said inner rotor member is spring driven.

7. A rocket launching mechanism as defined in claim 1, wherein said means for rotating said inner rotor member include a. a pinion member affixed to a shaft carried by said inner rotor member, b. a drive gear member freely rotatable on a stub shaft carried by said outer housing member, said gear member being in mesh with said pinion member, c. a coil spring attached to said gear member, and to said stub shaft, d. a unidirectional ratchet member affixed to said stub shaft with means to retain the tension in said spring until said drive gear drives said pinion member, e. and means to wind said coil spring to build up tension therein.

8. A rocket launching mechanism as defined in claim 1, wherein said means to fire a rocket from within said chamber includes a first trigger means carried by said stock member and said means for rotating said inner rotor member includes second trigger means carried by said stock member to effect a release of said stop assembly means.

9. A rocket launching mechanism as defined in claim 8, including crank means to move said stop assembly means into and out of said grooves in said inner rotor member and wherein actuation of said second trigger means effects rotation of said crank means.

10. A rocket launching mechanism as defined in claim 8, wherein said second trigger means carried by said stock member includes a. a trigger member pivotally supported by said stock member, 1. said trigger member having an upper portion extending above the pivot point of said trigger member and a lower portion below the pivot point intended to be pulled to effect an indexing of said magazine and reloading of said rocket launching mechanism, b. a trigger roller carried by the upper portion of said trigger member, c. a trigger rod member held for reciprocatory movement within said stock member, 1. said trigger rod member being centrally hinged so as to have a forward portion and a rearward portion with respect to its hinge, d. a wedge-shaped trigger catch held by the forward portion of said trigger rod member, e. spring means normally urging said wedge-shaped trigger catch on the forward portion of said trigger rod member and said trigger roller carried by the upper portion of said trigger member into a latched position, f. means actuated by said trigger member for unlatching said trigger catch from said trigger roller, g. and crank means actuated by said trigger rod to release said stop assembly means.

11. A rocket launching mechanism as defined in claim 10, wherein said means actuated by said trigger member for unlatching said trigger catch from said trigger roller includes a lift roller fixedly supported on said stock member and a cam member held by said forward portion of said trigger rod member and engageable with said lift roller.

* * * * *